US009739279B2

(12) United States Patent
Ichise et al.

(10) Patent No.: US 9,739,279 B2
(45) Date of Patent: Aug. 22, 2017

(54) LUBRICATION RESERVOIR AND RECIRCULATION ARRANGEMENT FOR SCROLL COMPRESSOR BEARING

(71) Applicant: MITSUBISHI HEAVY INDUSTRIES AUTOMOTIVE THERMAL SYSTEMS CO., LTD., Kiyosu-shi, Aichi (JP)

(72) Inventors: Yuki Ichise, Tokyo (JP); Goshi Iketaka, Tokyo (JP); Takayuki Suzuki, Tokyo (JP)

(73) Assignee: MITSUBISHI HEAVY INDUSTRIES AUTOMOTIVE THERMAL SYSTEMS CO., LTD., Aichi (JP)

( * ) Notice: Subject to any disclaimer, the term of this patent is extended or adjusted under 35 U.S.C. 154(b) by 0 days.

(21) Appl. No.: 14/903,889

(22) PCT Filed: Aug. 11, 2014

(86) PCT No.: PCT/JP2014/004170
§ 371 (c)(1),
(2) Date: Jan. 8, 2016

(87) PCT Pub. No.: WO2015/025502
PCT Pub. Date: Feb. 26, 2015

(65) Prior Publication Data

US 2016/0160861 A1 Jun. 9, 2016

(30) Foreign Application Priority Data

Aug. 23, 2013 (JP) ..... 2013-172972

(51) Int. Cl.
*F03C 2/00* (2006.01)
*F03C 4/00* (2006.01)
(Continued)

(52) U.S. Cl.
CPC ..... *F04C 29/065* (2013.01); *F04C 18/0215* (2013.01); *F04C 29/005* (2013.01);
(Continued)

(58) Field of Classification Search
CPC .... F04C 18/0215; F04C 23/008; F04C 29/02; F04C 29/026; F04C 29/028; F04C 29/06;
(Continued)

(56) References Cited

U.S. PATENT DOCUMENTS 4,898,521 A * 2/1990 Sakurai ..... F04C 18/0215 418/55.6
7,101,160 B2 * 9/2006 Gennami ..... F04C 18/0215 418/55.6
(Continued)

FOREIGN PATENT DOCUMENTS

JP 59-29793 A 2/1984
JP 2008-208717 A 9/2008
JP 2012-188989 A 10/2012

OTHER PUBLICATIONS

International Search Report issued in PCT/JP2014/004170, dated Nov. 11, 2014.

*Primary Examiner* — Theresa Trieu
(74) *Attorney, Agent, or Firm* — Birch, Stewart, Kolasch & Birch, LLP

(57) ABSTRACT

This electric horizontal scroll compressor (1) comprises an oil reservoir (13) in which lubricating oil that is separated from refrigerant passing through a compressing mechanism (20) is temporarily stored, and an oil return flow channel (15, 24) by which lubricating oil stored in the oil reservoir (13) is returned further upstream than the compressing mechanism (20). A main bearing (35) is fit into a holding face (14*a*) of an inner housing (14) by way of a clearance fit, and
(Continued)

lubricating oil stored in the oil reservoir (13) is supplied to the region of the fit via the oil return flow channel (15, 24).

10 Claims, 6 Drawing Sheets

(51) Int. Cl.

| | |
|---|---|
| ***F04C 2/00*** | (2006.01) |
| ***F04C 18/00*** | (2006.01) |
| ***F04C 29/06*** | (2006.01) |
| ***F04C 29/02*** | (2006.01) |
| ***F04C 18/02*** | (2006.01) |
| ***F04C 29/00*** | (2006.01) |
| *F04C 23/00* | (2006.01) |

(52) U.S. Cl.
CPC ..... *F04C 29/0085* (2013.01); *F04C 29/028* (2013.01); *F04C 29/06* (2013.01); *F04C 23/008* (2013.01); *F04C 29/026* (2013.01); *F04C 2240/50* (2013.01); *F04C 2240/52* (2013.01); *F04C 2240/56* (2013.01)

(58) Field of Classification Search
CPC F04C 29/065; F04C 29/0085; F04C 2240/50; F04C 2240/52; F04C 2240/54; F04C 2240/56; F04C 29/005; F04C 29/068
USPC ..... 418/55.1–55.6, 57, 90, 94, 97, 98, 270, 418/DIG. 1
See application file for complete search history.

(56) References Cited

U.S. PATENT DOCUMENTS

| | | | | |
|---|---|---|---|---|
| 7,264,453 | B2 * | 9/2007 | Gennami | F04C 18/0215 418/55.6 |
| 7,628,593 | B2 * | 12/2009 | Mizuno | F04C 18/0215 418/55.6 |
| 8,096,794 | B2 * | 1/2012 | Iwanami | F04C 18/0215 418/55.6 |
| 8,162,636 | B2 * | 4/2012 | Yokoi | F04C 18/0215 418/55.6 |
| 8,202,071 | B2 * | 6/2012 | Kii | F04C 18/0215 418/55.6 |
| 2011/0146215 | A1 * | 6/2011 | Lee | F04C 29/026 55/456 |

* cited by examiner

LUBRICATION RESERVOIR AND RECIRCULATION ARRANGEMENT FOR SCROLL COMPRESSOR BEARING

TECHNICAL FIELD

The present invention relates to a scroll compressor used in an air conditioner of a vehicle, for example.

BACKGROUND ART

A scroll compressor used in an air conditioning apparatus includes a fixed scroll and an orbiting scroll, each scroll having a spiral wrap as set forth in Patent Document 1, for example. Then, the orbiting scroll is set in a revolving orbiting motion relative to the fixed scroll, and the capacity of a compression chamber formed between both scroll walls is decreased, thereby compressing a refrigerant inside the compression chamber.

With the orbiting scroll set in the orbiting motion, vibration occurs in the scroll compressor. This vibration is based on several oscillation sources, such as torque variation of the orbiting scroll and pressure pulses of the refrigerant when the refrigerant is compressed. The vibration from the oscillation sources propagates to a main shaft (crank shaft) that transfers a rotational driving force from a drive power supply to the orbiting scroll, and is further transferred to a housing that forms an outer shell of the scroll compressor via a bearing that rotatably supports the main shaft, and transmitted outside the scroll compressor.

CITATION LIST

Patent Literature(s)

Patent Document 1: Japanese Unexamined Patent Application Publication No. 2008-208717A

SUMMARY OF THE INVENTION

Technical Problem

When the scroll compressor is used in an air conditioning apparatus of a vehicle, the vibration and a noise associated with the vibration need to be reduced to ensure quietness inside the vehicle cabin. Therefore, various proposals have been made up to the present time to reduce vibration in the scroll compressor for a vehicle. For example, Patent Document 1 proposes suppressing the occurrence of noise from members that constitute the main shaft. Despite the proposals to date, however, suppressing vibration and noise is not easy.

Hence, in view of the aforementioned vibration transfer path, an object of the present invention is to provide a scroll compressor capable of reducing vibration and noise from the scroll compressor by suppressing the transfer of vibration from a bearing to a housing.

Solution to Problem

On the basis of such an object, a horizontal scroll compressor of the present invention includes a compressing mechanism having an orbiting scroll that is set in a revolving orbiting motion, a main shaft that transmits a rotational force generated by a drive power supply to the orbiting scroll, an oil reservoir in which lubricating oil separated from refrigerant passing through the compressing mechanism is temporarily stored, and an oil return flow channel by which lubricating oil stored in the oil reservoir is returned further upstream than the compressing mechanism.

In the scroll compressor of the present invention, a bearing is fit by way of a clearance fit into a holding face that faces an outer peripheral surface of the bearing and holds the bearing, and lubricating oil stored in the oil reservoir is supplied to a region of the fit via the oil return flow channel.

It should be noted that, in the present invention, "upstream" and "downstream" are relative to the direction of flow of the refrigerant.

In the present invention, in addition to the fit of the bearing being a clearance fit, the lubricating oil stored in the oil reservoir included in the horizontal scroll compressor is supplied to the region of the fit, thereby forming an oil film in the region. This oil film functions as a damper that attenuates the vibration of the bearing, thereby suppressing the transfer of vibration from the bearing to the housing, making it possible to reduce the vibration and noise from the scroll compressor.

In the scroll compressor of the present invention, an oil groove extending in a circumferential direction is preferably formed on one or both of the holding face and the outer peripheral surface of the bearing facing the holding face.

According to this preferred embodiment, an amount of the lubricating oil stored in the region of the fit increases by the amount of the oil groove, thereby improving the damper effect resulting from the oil film.

In the scroll compressor of the present invention, a discharge channel that discharges the supplied lubricating oil in an axial direction of the bearing is preferably provided between the holding face and the outer peripheral surface of the bearing facing the holding face.

According to this preferred embodiment, the discharge channel is provided, making it possible to selectively supply the lubricating oil that functions as a damper to mechanical elements that require lubrication.

In the scroll compressor of the present invention, when a snap ring that regulates a displacement in the axial direction of the bearing is provided, the snap ring is preferably provided so that the snap ring, excluding a split opening thereof, blocks the region of the fit from the axial direction and the split opening corresponds to the discharge channel.

According to this preferred embodiment, the section through which the lubricating oil that has formed the oil film is discharged is limited, thereby making it possible to supply the lubricating oil to the required area.

In the scroll compressor of the present invention, the discharge channel is preferably provided to an uppermost region in a height direction.

According to this preferred embodiment, it is possible to supply lubricating oil more efficiently to the mechanical elements provided below the discharge channel.

Advantageous Effects of Invention

According to the present invention, in addition to the fit of the bearing being a clearance fit, the lubricating oil stored in the oil reservoir included in the horizontal scroll compressor is supplied to the region of the fit, thereby making it possible for the oil film formed in the region to function as a damper that attenuates the vibration of the bearing. Thus, according to the compressor of the present invention, the transfer of vibration from the bearing to the housing is suppressed, making it possible to reduce the vibration and noise from the scroll compressor.

BRIEF DESCRIPTION OF DRAWING(S)

DESCRIPTION OF EMBODIMENTS

Figure 1:
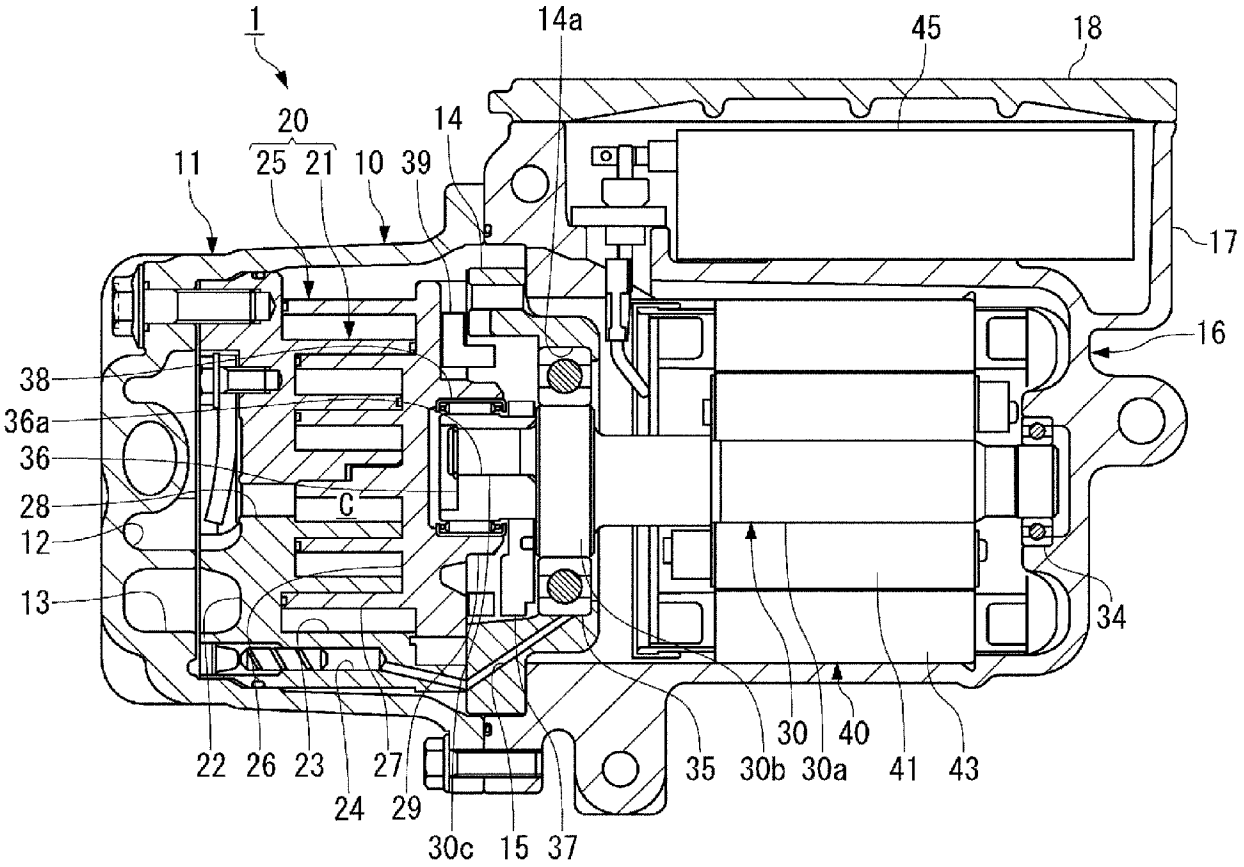
FIG. 1 is a partial longitudinal sectional view illustrating an electric horizontal scroll compressor of the present embodiment.

The following describes in detail an embodiment of the present invention with reference to the accompanying drawings. In the present embodiment, an example in which the present invention is applied to an electric horizontal-type scroll compressor 1 that is supplied with power via an inverter is described.

[Configuration]

First, the configuration of the electric compressor 1 will be described with reference to FIG. 1 and FIG. 2.

The electric compressor 1 includes a housing 10 that forms an outer shell thereof, a compressing mechanism 20 having a fixed scroll 21 and an orbiting scroll 25 that compress refrigerant used in a vehicle air conditioner, a main shaft 30 that drives the orbiting scroll 25, and an electric motor 40 that drives the main shaft 30.

[Housing]

The housing 10 has a three-piece structure formed by a compressor housing 11, an inner housing 14, and a motor housing 16. Each of the members is manufactured by die casting an aluminum alloy, for example. The fixed scroll 21 and the orbiting scroll 25 are manufactured by forging.

The compressor housing 11 is a member formed into a bottomed cylindrical shape, and the fixed scroll 21 is fixed to the bottom surface. A discharge chamber 12 into which refrigerant compressed by the fixed scroll 21 and the orbiting scroll 25 flows is formed between the compressor housing 11 and the fixed scroll 21.

Further, an oil reservoir 13 is provided between the compressor housing 11 and the fixed scroll 21. The oil reservoir 13 is a space formed between the compressor housing 11 and the fixed scroll 21, and temporarily stores the lubricating oil included in the refrigerant discharged from a discharge port 28. It should be noted that the lubricating oil included in the refrigerant is separated by an oil separator (not illustrated) and then moved to the oil reservoir 13. The lubricating oil stored in the oil reservoir 13 passes through an oil return flow channel 24 formed in the fixed scroll 21, returns to an upstream side of the electric compressor 1, and is included in the refrigerant. The refrigerant that includes the lubricating oil is compressed by the compressing mechanism 20 and then discharged to the discharge chamber 12. Thus, the lubricating oil lubricates sliding sections such as a main bearing 35, a sub-bearing 34, the fixed scroll 21, and the orbiting scroll 25 while circulating through the interior of the electric compressor 1.

It should be noted that, in the present embodiment, "upstream" and "downstream" are relative to the direction of flow of the refrigerant.

The inner housing 14 is disposed so as to be inserted between the compressor housing 11 and the motor housing 16.

The main bearing 35 that rotatably supports the main shaft 30 is retained on the inner housing 14.

An oil return flow channel 15 is formed in the inner housing 14. The oil return flow channel 15 is communicated with an oil return flow channel 24 provided to the fixed scroll 21 on one end, and opens on a holding face 14*a* facing the outer peripheral surface of an outer ring 35*b* (FIG. 2) of the main bearing 35 on the other end. Accordingly, the electric compressor 1 includes a lubricating oil return flow channel made of the oil return flow channel 24 and the oil return flow channel 15, between the oil reservoir 13 and the main bearing 35 (outer ring 35*b*).

A stator 43 of the electric motor 40 is fixed to the interior of the motor housing 16. An intake port (not illustrated) into which refrigerant flows from the outside, and an inverter housing box 17 are provided to the motor housing 16.

The inverter housing box 17 includes an opening having an upper portion that is closed by a lid 18, and houses an inverter device 45 that controls the driving of the electric motor 40 inside the closed space.

[Compressing Mechanism 20]

The fixed scroll 21 and the orbiting scroll 25 that form the compressing mechanism 20 form a closed compression chamber C, as illustrated in FIG. 1, and compress the refrigerant.

The fixed scroll 21 includes a fixed end plate 22, and a spiral-shaped fixed wrap 23 that extends from the fixed end plate 22 toward the orbiting scroll 25. The oil return flow channel 24 is formed in the fixed end plate 22. The oil return flow channel 24 is communicated with the oil reservoir 13 on one end, and with the oil return flow channel 15 formed in the inner housing 14 on the other end.

The discharge port 28 is provided in a center portion of the fixed end plate 22, and the refrigerant compressed in the compression chamber C is discharged to the discharge chamber 12 via the discharge port 28.

The orbiting scroll 25 includes an orbiting end plate 26, and a spiral-shaped orbiting wrap 27 that extends from the orbiting end plate 26 toward the fixed scroll 21. The orbiting scroll 25 is supported by the main shaft 30 and a rotation preventing part (Oldham ring) 39 so as to be capable of revolving.

The orbiting end plate 26 includes a cylindrical boss 29 that extends toward the main shaft 30, on a surface facing the main shaft 30. A needle bearing 38 that rotatably supports a bush 36 to which the revolving driving force by the main shaft 30 is transferred is disposed on the boss 29.

[Main Shaft 30]

The main shaft 30 is a cylindrical member arranged from the electric motor 40 to the orbiting scroll 25, and is supported by the compressor housing 11 via the sub-bearing 34 and the main bearing 35 so as to freely rotate. The main shaft 30 includes a cylindrical crank shaft 30*a* fixed to a rotor 41, a disk-shaped fitting part 30*b* having a diameter greater than that of the crank shaft 30*a*, and a crank pin 30*c* that extends along a center axis from a position eccentric from the center axis to the crank shaft 30*a*.

The crank shaft 30*a* is disposed so that the center axis thereof is substantially horizontal, and transfers the rotational driving force generated by the rotor 41 and the stator 43 to the orbiting scroll 25.

The fitting part 30*b* is a section that is fitted to and supported by the main bearing 35, and the crank shaft 30*a* is provided to a first surface side and the crank pin 30*c* is provided to a second surface side in the axial direction. It should be noted that the fitting part 30*b* is supported by the main bearing 35 by being press-fitted to the inner side of the inner ring 35*a* (FIG. 2) of the main bearing 35.

The crank pin 30*c* transfers the rotational driving force transferred to the crank shaft 30*a* to the orbiting scroll 25, driving the orbiting scroll 25 to orbit. The crank pin 30*c* extends from a position eccentric from the center of the fitting part 30*b* toward the orbiting scroll 25 along the center axis of the crank shaft 30*a*.

Figure 2:
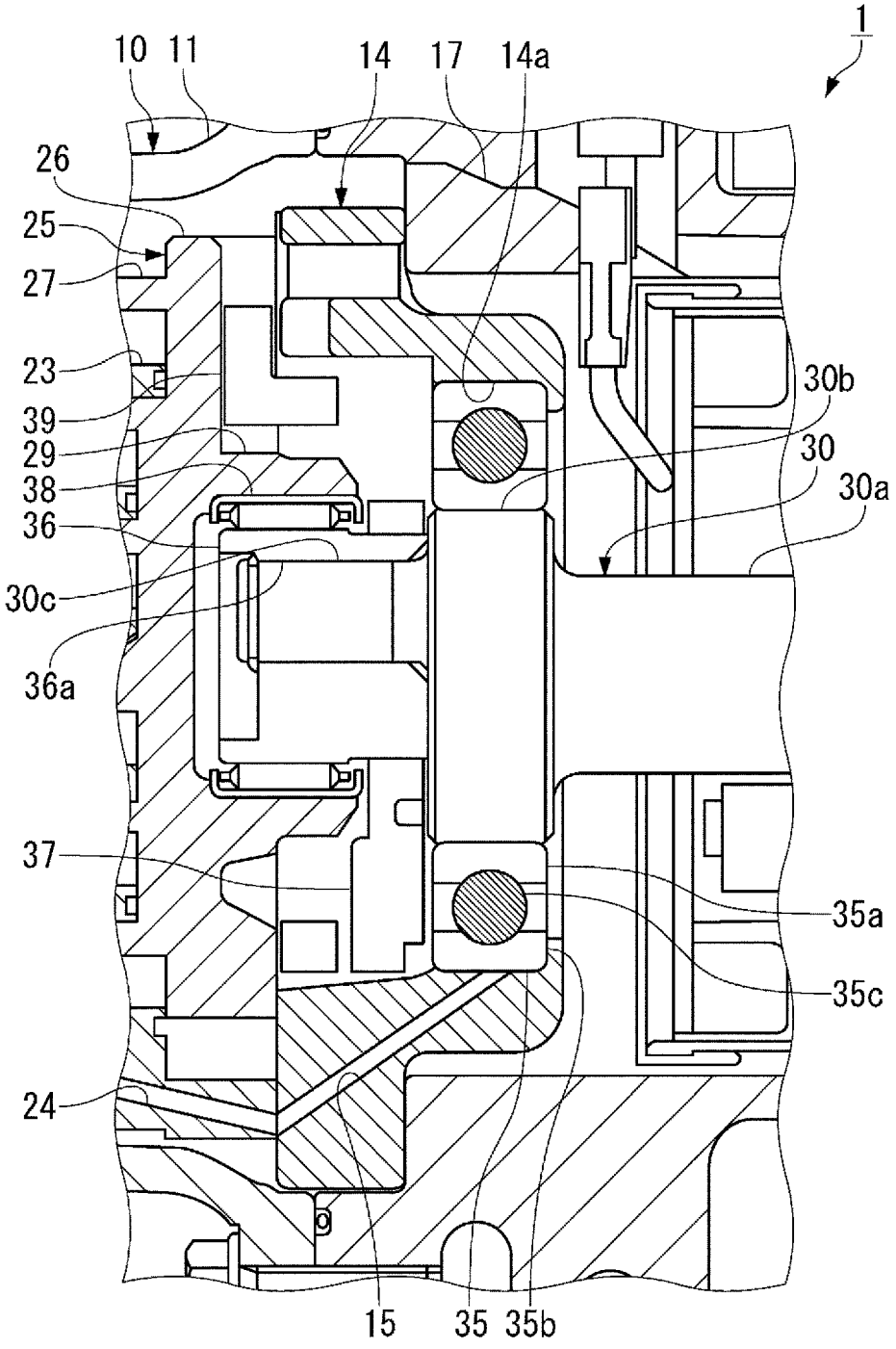
FIG. 2 is a partial enlarged view of FIG. 1.

The main bearing 35, as illustrated in FIG. 2, is a radial bearing made of an inner ring 35*a*, the outer ring 35*b*, and a plurality of spherical rolling elements 35*c* provided between the inner ring 35*a* and the outer ring 35*b*. The inner ring 35*a* supports the fitting part 30*b* of the main shaft 30, and rotates synchronously with the rotation of the main shaft 30. The main bearing 35 is supported by a clearance fit (JISB0401) in the inner housing 14, and the fitting of the main bearing 35 and the inner housing 14 is a special feature of the present embodiment.

The bush 36 is disposed between the crank pin 30*c* and the boss 29. The bush 36 is a substantially cylindrical member that transfers the revolving driving force to the orbiting scroll 25. A crank hole 36*a* through which the crank pin 30*c* is inserted is formed in a position eccentric from the center of the bush 36.

The needle bearing 38 that rotatably supports the bush 36 is provided between the bush 36 and the boss 29.

A counterweight 37 is provided on the outer circumference of the bush 36. The counterweight 37 is a member that regulates a pressing force of the orbiting scroll 25 with respect to the fixed scroll 21, and provides balance.

Although not illustrated, a limit pin, which is a member that regulates a revolving radius of the orbiting scroll 25, and a limit hole into which the limit pin is inserted are provided around the main shaft 30.

[Electric Motor 40]

The electric motor 40 is rotationally driven by a frequency-controlled alternating current, and is a drive power supply that drives the orbiting scroll 25 into a revolving orbiting motion.

The electric motor 40, as illustrated in FIG. 1, includes the rotor 41 that causes the orbiting scroll 25 to revolve and orbit via the main shaft 30, and the stator 43. Alternating current controlled from the inverter device 45 is supplied to the stator 43.

The rotor 41 generates a rotational driving force by an alternating current magnetic field formed by the stator 43, and is made of a permanent magnet formed into a cylindrical shape. The crank shaft 30*a* of the main shaft 30 is fixed to the rotor 41.

The stator 43 forms the alternating current magnetic field and rotates the rotor 41 on the basis of the alternating current supplied from the inverter device 45. The stator 43 is fixed to the inner peripheral surface of the motor housing 16 by a method such as shrink fitting.

The inverter device 45 controls the alternating current supplied to the stator 43, and is disposed inside the inverter housing box 17. The inverter device 45 includes a plurality of substrates that include electronic elements such as a capacitor and a power transistor.

[Operation]

Next, the procedure by which the electric compressor 1 having the above-described configuration compresses the refrigerant will be described.

Direct current supplied from outside is subjected to frequency control by an electronic element such as the power transistor of the inverter device 45, and supplied to the stator 43.

The stator 43 forms an alternating current magnetic field on the basis of the alternating current subjected to frequency control, and the rotor 41 generates a rotational driving force by interaction with the formed alternating current magnetic field. The rotational driving force generated by the rotor 41 is transferred to the main shaft 30.

The rotational driving force is transferred to the crank shaft 30*a* and the fitting part 30*b* of the main shaft 30, and the crank pin 30*c* is driven to orbit by the rotation of the fitting part 30*b*. The orbiting motion of the crank pin 30*c* is transferred to the orbiting scroll 25 via the bush 36 and the boss 29. The orbiting scroll 25 is driven to revolve while the rotational movement thereof is regulated by the rotation preventing part 39.

When the orbiting scroll 25 is driven to revolve, the compression chamber C formed between the orbiting scroll 25 and the fixed scroll 21 captures and compresses the refrigerant that has flowed from the motor housing 16 into the interior of the electric compressor 1. Specifically, the compression chamber C captures the refrigerant on the outer peripheral end of the fixed scroll 21 and the orbiting scroll 25. Then, with the revolving of the orbiting scroll 25, the compression chamber C decreases in capacity while moving from the outer peripheral end toward a center side along the fixed wrap 23 and the orbiting wrap 27.

The refrigerant compressed in the compression chamber C is discharged to the discharge chamber 12 via the discharge port 28 of the fixed scroll 21, and discharged from inside the discharge chamber 12 to outside the housing 10 (compressor housing 11).

The lubricating oil separated from the refrigerant that flowed into the discharge chamber 12 flows into the oil reservoir 13. Here, while the electric compressor 1 is driving, the interior of the housing 10 has a relatively low pressure atmosphere on an upstream side and a relatively high pressure atmosphere on a downstream side with the compressing mechanism 20 serving as a boundary. Then, the lubricating oil return flow channel made of the oil return flow channel 24 and the oil return flow channel 15 provided between the oil reservoir 13 and the main bearing 35 (outer ring 35*b*) is communicated with the low pressure atmosphere on one end of the main bearing 35 side and the high pressure atmosphere on one end of the oil reservoir 13 side. Accordingly, because of the pressure differential between the high pressure atmosphere and the low pressure atmosphere, the lubricating oil stored in the oil reservoir 13 passes through the oil return flow channel 24 and the oil return flow channel 15, in that order, and is discharged from the holding face 14*a* of the inner housing 14.

Figure 3:
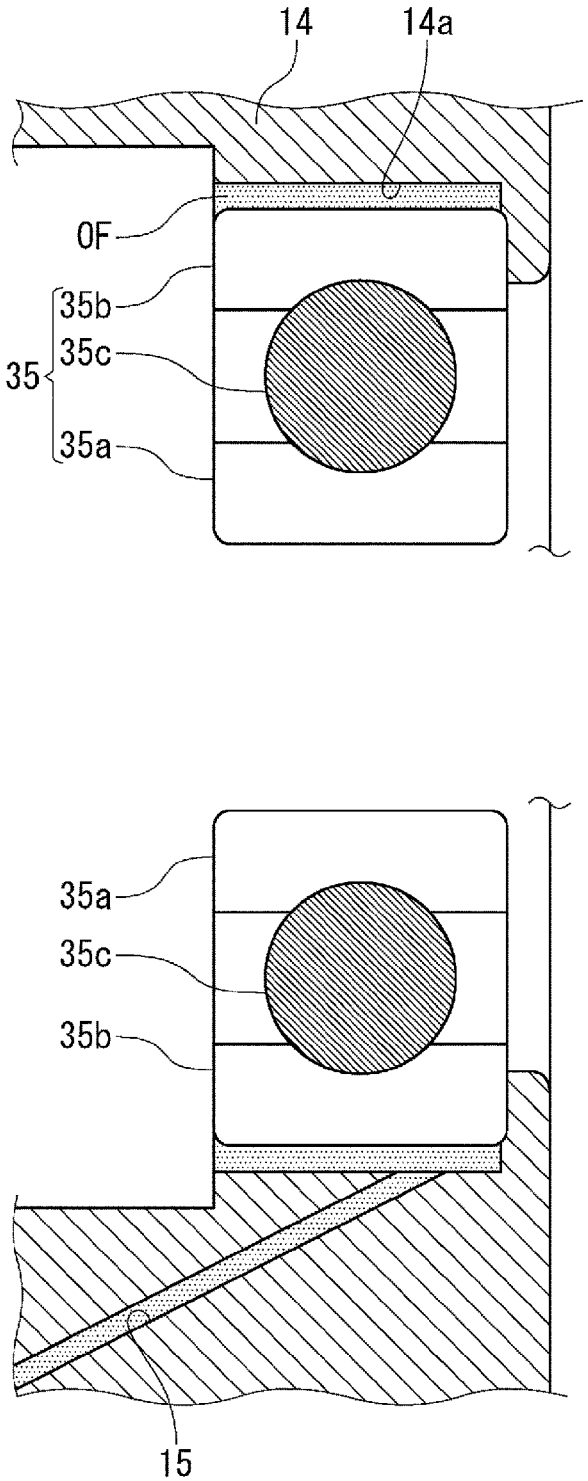
FIG. 3 is an enlarged view illustrating a vicinity of an outer ring of a main bearing of the present embodiment.

The discharged lubricating oil permeates the area surrounding the outer ring 35*b* of the main bearing 35 held by the clearance fit on the inner side of the holding face 14*a* and, as illustrated in FIG. 3, forms an oil film OF between the main bearing 35 and the holding face 14*a*. This oil film OF functions as a damper with respect to the main bearing 35. Accordingly, it is possible to suppress the vibration produced in the electric compressor 1 from being transferred to the housing 10 via the main bearing 35. Moreover, the lubricating oil that forms the oil film OF is continually supplied while the electric compressor 1 is driving, making it possible to achieve the damper effect by oil film formation in a stable manner.

While the above has described the basic configuration and effects of the electric compressor 1 according to the present embodiment, the present invention may include several options. The following describes, in order, the options.

[Selection of Discharge Destination of Lubricating Oil by Snap Ring]

Figure 4:
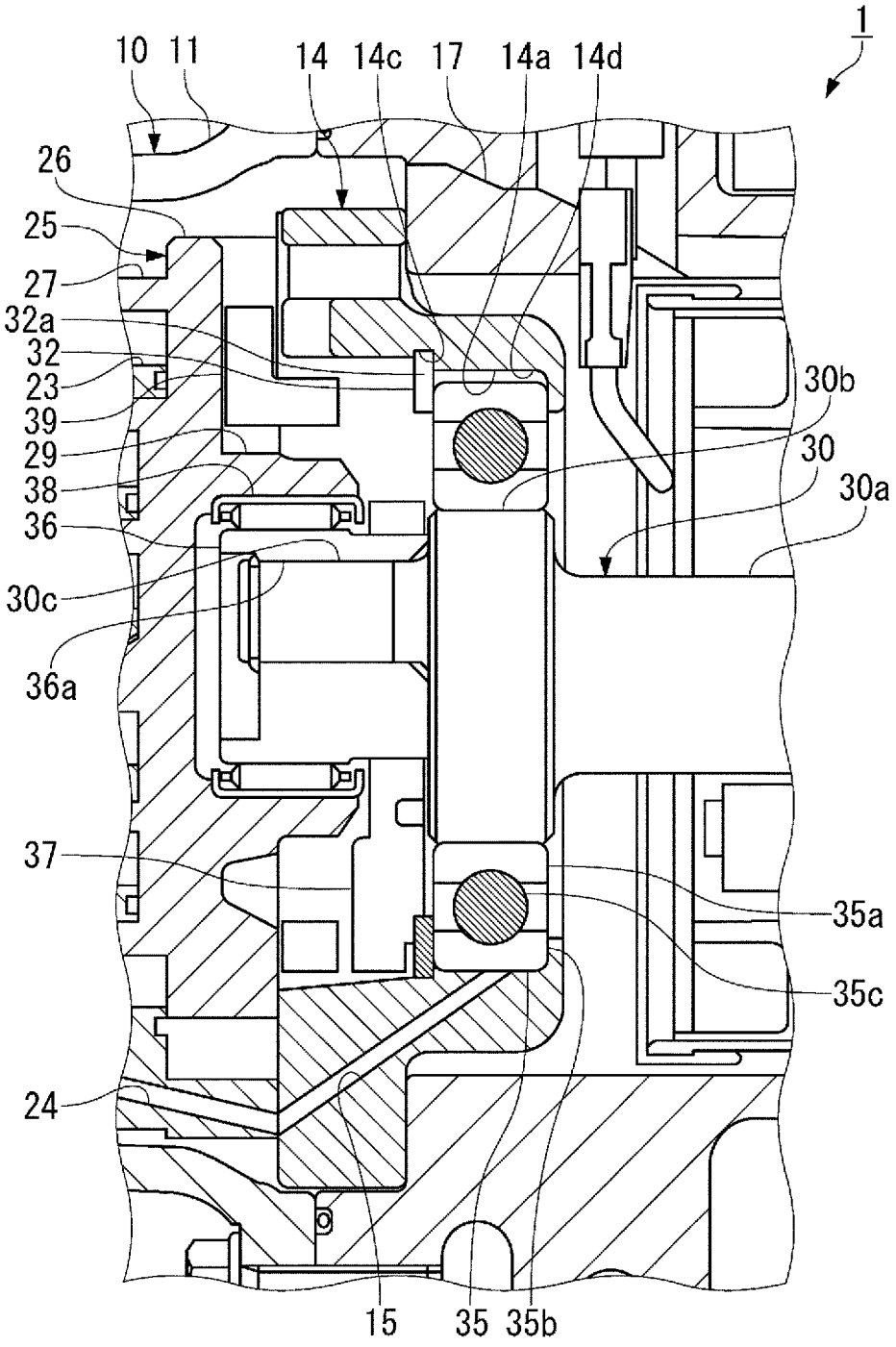
FIG. 4 is an enlarged view of a section corresponding to FIG. 2, illustrating a modification of the present embodiment in which a snap ring is provided.
Figure 5:
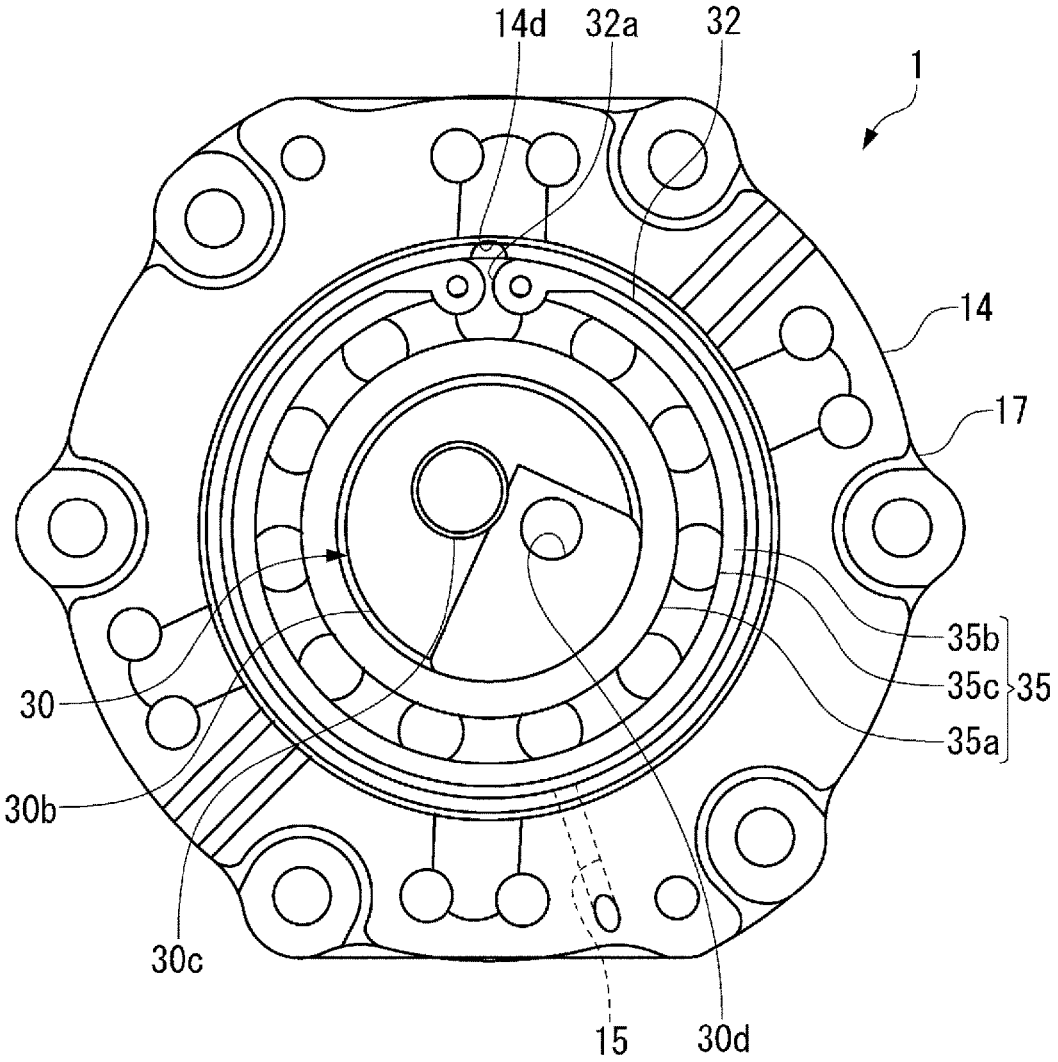
FIG. 5 is a cross-sectional view of the modification illustrated in FIG. 4.

The electric compressor 1 may be provided with a snap ring 32 for retaining the main bearing 35, as illustrated in FIG. 4 and FIG. 5. When the electric compressor 1 rises in temperature while driving, the housing 10 made of an aluminum alloy has a larger amount of thermal expansion than that of the main bearing 35 made of an iron-based alloy, and therefore the snap ring 32 is provided to prevent the main bearing 35 from coming out in the axial direction.

The snap ring 32 is a ring-shaped metal member that includes a split opening 32*a* having a portion thereof cut out in the radial direction. Here, an outer edge side of the snap ring 32 is inserted into a holding groove 14*c* formed so as to extend in the circumferential direction of the inner peripheral surface of the inner housing 14, and is fixed to the inner housing 14 by a suitable fastening means. The snap ring 32 is disposed so as to be in contact with one end surface in the axial direction of the main bearing 35, thereby fulfilling a retaining function of the main bearing 35.

The snap ring 32 is disposed so that the split opening 32*a* is positioned in an uppermost area in the height direction. Accordingly, in a gap between the holding face 14*a* of the inner housing 14 and the outer ring 35*b* of the main bearing 35, the uppermost region provided with the split opening 32*a* is open to the outside, and the region below this region is sealed by the snap ring 32. Moreover, a discharge channel 14*d* is formed on the holding face 14*a* of the inner housing 14 in correspondence with this uppermost position.

While the lubricating oil that constitutes the oil film formed between the holding face 14*a* and the outer ring 35*b* is pushed upward to the uppermost region due to the effect of the aforementioned pressure differential, this region is open to the outside and provided with the discharge channel 14*d*, causing the lubricating oil that had been pushed upward to be easily discharged toward the outside. The discharged lubricating oil is dripped toward sliding members such as the bush 36 and the needle bearing 38 disposed below the discharged position.

As described above, the position of the split opening 32*a* of the snap ring 32 that retains the main bearing 35 is selected, thereby making it possible to supply lubricating oil to a drive bush in a stable manner and thus ensure the reliability of the electric compressor 1.

[Ensuring Oil Film Amount by Oil Groove Formation]

Figure 6B:
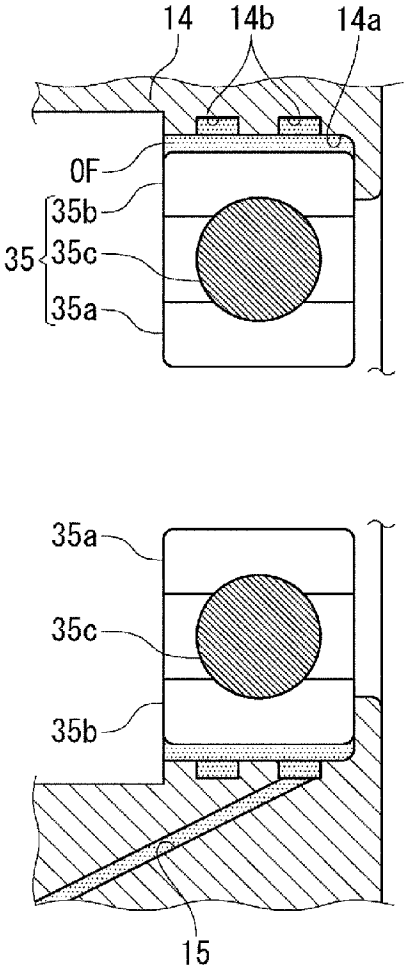
FIG. 6A and FIG. 6B are enlarged views of a section corresponding to FIG. 3, illustrating a modification of the present embodiment in which an oil groove is provided.
Figure 6A:
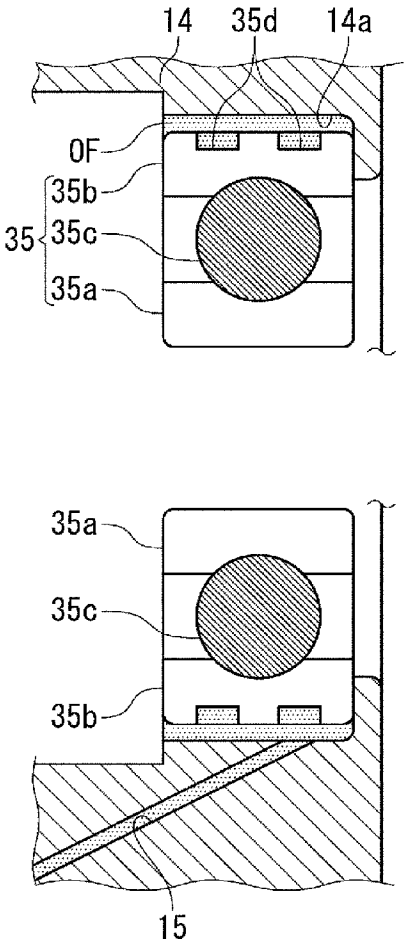

The electric compressor 1, as illustrated in FIG. 6A, may be provided with oil grooves 35*d*, 35*d* extending in the circumferential direction of the outer peripheral surface of the outer ring 35*b* of the main bearing 35. With the provision of the oil grooves 35*d*, 35*d*, the amount of lubricating oil that exists as an oil film between the holding face 14*a* and the outer ring 35*b* can be increased, making it possible to improve the damper effect resulting from oil film formation.

The oil grooves for increasing the amount of lubricating oil may also be provided on the holding face 14*a* of the inner housing 14, as illustrated in FIG. 6B. Formation of oil grooves 14*b*, 14*b* is easy in terms of machining compared to formation of the oil grooves 35*d*, 35*d* on the outer peripheral surface of the outer ring 35*b*. That is, the bearing is normally distributed with the outer peripheral surface of the outer ring being flat, and therefore the oil grooves 35*d*, 35*d* need to be formed by performing a cutting process once again. Conversely, when the oil grooves 14*b*, 14*b* are provided on the inner housing 14, the oil grooves 14*b*, 14*b* need only be formed simultaneously with other portions during casting, making further machining not required or only slight machining to the extent of finishing the surfaces of the oil grooves 14*b*, 14*b* necessary.

The oil grooves for increasing the amount of lubricating oil may be formed on both the outer ring 35*b* of the main bearing 35 and the holding face 14*a* of the inner housing 14. Further, while the oil grooves are formed into two rows (oil grooves 35*d*, 35*d*, and oil grooves 14*b*, 14*b*) here, the two rows are merely an example, allowing formation into one row or three rows as well.

The embodiments of the present invention are described above. However, as long as there is no departure from the spirit and scope of the present invention, configurations described in the modes of the above embodiments can be selected as desired, or can be changed to other configurations as necessary.

For example, while the housing 10 of the electric compressor 1 forms a three-piece structure, the present invention may also be applied to an electric compressor of a housing having a two-piece structure.

Further, while the drive power supply of the compressing mechanism 20 serves as the electric motor 40 in the above embodiment, the drive power supply is not limited thereto, allowing the present invention to be applied to a compressor having an automobile engine as the drive power supply, for example.

REFERENCE SIGNS LIST

1 Electric compressor
10 Housing
11 Compressor housing
12 Discharge chamber
13 Oil reservoir
14 Inner housing
14*a* Holding face
14*b* Oil groove
14*c* Holding groove
15, 24 Oil return flow channel
16 Motor housing
17 Inverter housing box
18 Lid
20 Compressing mechanism
21 Fixed scroll
22 Fixed end plate
23 Fixed wrap
25 Orbiting scroll
26 Orbiting end plate
27 Orbiting wrap
28 Discharge port
29 Boss
30 Main shaft
30*a* Crank shaft
30*b* Fitting part
30*c* Crank pin
32 Snap ring
32*a* Split opening
34 Sub-bearing
35 Main bearing
35*a* Inner ring
35*b* Outer ring
35*c* Rolling element

35*d*, 35*d* Oil groove
36 Bush
36*a* Crank hole
37 Counterweight
38 Needle bearing
39 Rotation preventing part
40 Electric motor
41 Rotor
43 Stator
45 Inverter device
C Compression chamber

The invention claimed is:

1. A horizontal scroll compressor comprising:

a compressing mechanism that includes an orbiting scroll that is set in a revolving orbiting motion;

a main shaft that transmits a rotational force generated by a drive power supply to the orbiting scroll;

a bearing that rotatably supports the main shaft;

an oil reservoir that temporarily stores lubricating oil separated from refrigerant passing through the compressing mechanism; and an oil return flow channel for returning the lubricating oil stored in the oil reservoir further upstream than the compressing mechanism;

the bearing being fit by way of a clearance fit into a holding face that faces an outer peripheral surface of the bearing and holds the bearing;

the lubricating oil stored in the oil reservoir being supplied to a region of the fit via the oil return flow channel; and the horizontal scroll compressor further including a discharge channel that discharges the supplied lubricating oil in an axial direction of the bearing, between the holding face and the outer peripheral surface of the bearing facing the holding face.

2. The scroll compressor according to claim 1, wherein an oil groove extending in a circumferential direction is formed on one or both of the holding face and the outer peripheral surface of the bearing facing the holding face.

3. The scroll compressor according to claim 1, further comprising a snap ring that regulates a displacement in the axial direction of the bearing;

the snap ring provided so that the snap ring, excluding a split opening of the snap ring, blocks a region of the fit from the axial direction, and the split opening corresponds to the discharge channel.

4. The scroll compressor according to claim 1, wherein the discharge channel is provided so as to include an uppermost position in a height direction.

5. The scroll compressor according to claim 3, wherein the discharge channel is provided so as to include an uppermost position in a height direction.

6. The scroll compressor according to claim 1, further comprising a first housing that houses the compressing mechanism, a second housing that houses the drive power supply; and a third housing that is disposed so as to be inserted between the first housing and the second housing;

the holding face being formed on the third housing.

7. The scroll compressor according to claim 6, wherein a portion of the oil return flow channel is formed in the third housing.

8. The scroll compressor according to claim 7, wherein an end of the oil return flow channel opens on the holding face.

9. The scroll compressor according to claim 6, wherein the oil reservoir is formed between the first housing and a fixed scroll constituting a portion of the compressing mechanism.

10. The scroll compressor according to claim 9, wherein a portion of the oil return flow channel is formed in the fixed scroll.

* * * * *